US010077604B2

(12) United States Patent
Chambers et al.

(10) Patent No.: US 10,077,604 B2
(45) Date of Patent: Sep. 18, 2018

(54) SEALING ELEMENT MOUNTING

(71) Applicant: Weatherford Technology Holdings, LLC, Houston, TX (US)

(72) Inventors: James W. Chambers, Houston, TX (US); Richard D. Wilson, Van Buren, AR (US)

(73) Assignee: Weatherford Technology Holdings, LLC, Houston, TX (US)

( * ) Notice: Subject to any disclaimer, the term of this patent is extended or adjusted under 35 U.S.C. 154(b) by 628 days.

(21) Appl. No.: 14/701,169

(22) Filed: Apr. 30, 2015

(65) Prior Publication Data

US 2015/0315845 A1 Nov. 5, 2015

Related U.S. Application Data

(60) Provisional application No. 61/986,544, filed on Apr. 30, 2014.

(51) Int. Cl.

| | |
|---|---|
| ***E21B 3/04*** | (2006.01) |
| ***E21B 19/00*** | (2006.01) |
| ***E21B 33/03*** | (2006.01) |
| ***E21B 33/08*** | (2006.01) |

(52) U.S. Cl.

CPC ..... *E21B 3/04* (2013.01); *E21B 19/00* (2013.01); *E21B 33/03* (2013.01); *E21B 33/085* (2013.01)

(58) Field of Classification Search

CPC ..... E21B 19/00; E21B 33/03; E21B 33/085

See application file for complete search history.

(56) References Cited

U.S. PATENT DOCUMENTS 2,731,281 A * 1/1956 Knox ..... E21B 33/06 277/326
2,945,665 A * 7/1960 Regan ..... E21B 33/06 166/196
3,583,480 A * 6/1971 Regan ..... E21B 33/064 166/352
3,614,111 A * 10/1971 Regan ..... E21B 33/064 166/84.4

(Continued)

FOREIGN PATENT DOCUMENTS

WO 2013052830 A2 4/2013

OTHER PUBLICATIONS

Australian Examination Report dated May 16, 2017 for AU Patent Application No. 2015253019, 5 pages.

(Continued)

*Primary Examiner* — Matthew R Buck
*Assistant Examiner* — Aaron Lloyd Lembo
(74) *Attorney, Agent, or Firm* — Smith IP Services, P.C.

(57) ABSTRACT

A sealing assembly for sealing against a piece of oilfield equipment in a wellbore. The sealing assembly has a support housing and the support housing defines an inner wall and a port configured for fluid communication with the wellbore. Such inner wall defines a stop shoulder, and the support housing has a limit structure proximate one or both end(s). A sealing element is contained within the support housing. A ring is connected to the sealing element at one or both end(s). Each ring is configured for slidable movement along the inner wall of the support housing and further configured to float between the stop shoulder and the limit structure.

20 Claims, 3 Drawing Sheets

(56) References Cited

U.S. PATENT DOCUMENTS

| | | | | |
|---|---|---|---|---|
| 4,423,775 | A * | 1/1984 | Wilson | E21B 33/08 166/84.4 |
| 4,441,551 | A * | 4/1984 | Biffle | E21B 33/085 166/84.3 |
| 5,178,215 | A | 1/1993 | Yenulis et al. | |
| 6,129,152 | A | 10/2000 | Hosie et al. | |
| 7,040,394 | B2 * | 5/2006 | Bailey | E21B 33/085 166/84.2 |
| 7,380,590 | B2 * | 6/2008 | Hughes | E21B 33/085 166/84.3 |
| 7,779,903 | B2 * | 8/2010 | Bailey | E21B 33/085 166/84.4 |
| 7,934,545 | B2 * | 5/2011 | Bailey | E21B 33/085 166/387 |
| 8,028,750 | B2 * | 10/2011 | Hughes | E21B 33/085 166/250.01 |
| 8,353,337 | B2 * | 1/2013 | Bailey | E21B 33/085 166/84.2 |
| 2005/0241833 | A1 | 11/2005 | Bailey et al. | |
| 2010/0307772 | A1 | 12/2010 | Bailey et al. | |
| 2013/0192847 | A1 * | 8/2013 | Bailey | E21B 33/02 166/373 |
| 2015/0144400 | A1 * | 5/2015 | Leuchtenberg | E21B 34/00 175/25 |
| 2015/0315874 | A1 * | 11/2015 | Chambers | E21B 36/001 166/302 |
| 2016/0273297 | A1 * | 9/2016 | Hannegan | E21B 33/085 |

OTHER PUBLICATIONS

International Search Report with Written Opinion dated Jan. 26, 2016 for PCT Patent Application No. PCT/US2015/028586, 15 pages.

* cited by examiner

SEALING ELEMENT MOUNTING

BACKGROUND

Technical Field

Exemplary embodiments disclosed herein relate to techniques for sealing against downhole tools in a wellbore.

Oilfield operations may be performed in order to extract fluids from the earth. When a well site is completed, pressure control equipment may be placed near the surface of the earth including in a subsea environment. The pressure control equipment may control the pressure in the wellbore while drilling, completing and producing the wellbore. The pressure control equipment may include blowout preventers (BOP), rotating control devices, and the like.

The rotating control device or RCD is a drill-through device with a rotating seal that contacts and seals against the drill string (drill pipe, casing, drill collars, etc.) for the purposes of controlling the pressure or fluid flow to the surface. The RCD may have multiple seal assemblies and, as part of a seal assembly, may have two or more seal elements in the form of stripper rubbers for engaging the drill string and controlling pressure up and/or downstream from the stripper rubbers. For reference to existing descriptions of rotating control devices and/or for controlling pressure please see U.S. Pat. Nos. 5,662,181; 6,138,774; 6,263,982; 7,159,669; and 7,926,593 the disclosures of which are hereby incorporated by reference.

In addition, the seal elements in the RCD or other pressure control equipment have a tendency to wear out quickly. These seal elements experience both pressure loads (such as wellbore pressure) and friction loads (such as friction caused by interaction between a tool joint and the sealing element). Such load(s) applied across the lower or upper end of the sealing element may be referred to as an end load. Relatedly, and by way of example, tool joints passing through the sealing element may cause failure in the sealing element via stresses eventually causing fatigue and/or parts of seal material tearing out of the sealing element. In high pressure, and/or high temperature wells the need is even greater for a more robust and efficiently designed seal element and/or seal holder. As the drill string is run into, and/or out of the RCD, this movement may have certain effects that could enhance the risk of failure as the sealing element experiences increased loads. The lateral and axial movement (upward or downward) will cause deformation and wear on the seal elements as further described below. For reference to existing descriptions of seal elements and/or sealing assemblies please see U.S. Pat. Nos. 6,910,531 and 7,926,560 the disclosures of which are hereby incorporated by reference.

Sealing elements may also be either passive or active activation. In one kind of passive sealing element design, the top end of the sealing element may be mounted to the bearing assembly in the RCD. In use, the highest load placed on the sealing element is when a tool joint is stripped out of the hole. If enough pressure and/or friction is placed on the sealing element, the sealing element will turn inside out during this motion. A properly designed sealing element will resist turning inside out, but may suffer damage near its metal mounting ring. Thus, there is a need for an improved RCD for reducing the wear on the seal elements in the RCD.

SUMMARY

A sealing assembly is disclosed for sealing against a piece of oilfield equipment in a wellbore. The sealing assembly has a support housing and the support housing defines an inner wall and a port configured for fluid communication with the wellbore. Such inner wall defines a stop shoulder, and the support housing has a limit structure proximate one or both end(s). A sealing element is contained within the support housing. A ring is connected to the sealing element at one or both end(s). Each ring is configured for slidable movement along the inner wall of the support housing and further configured to float between the stop shoulder and the limit structure.

As used herein the term "RCD" or "RCDs" and the phrase "pressure control apparatus" or "pressure control device(s)" shall refer to pressure control apparatus/device(s) including, but not limited to, blow-out-preventer(s) (BOPs), and rotating-control-device(s) (RCDs).

BRIEF DESCRIPTION OF THE DRAWINGS

The exemplary embodiments may be better understood, and numerous objects, features, and advantages made apparent to those skilled in the art by referencing the accompanying drawings. These drawings are used to illustrate only exemplary embodiments, and are not to be considered limiting of its scope, for the disclosure may admit to other equally effective exemplary embodiments. The figures are not necessarily to scale and certain features and certain views of the figures may be shown exaggerated in scale or in schematic in the interest of clarity and conciseness.

DESCRIPTION OF EXEMPLARY EMBODIMENT(S)

The description that follows includes exemplary apparatus, methods, techniques, and instruction sequences that embody techniques of the inventive subject matter. However, it is understood that the described exemplary embodiments may be practiced without these specific details.

Figure 1:
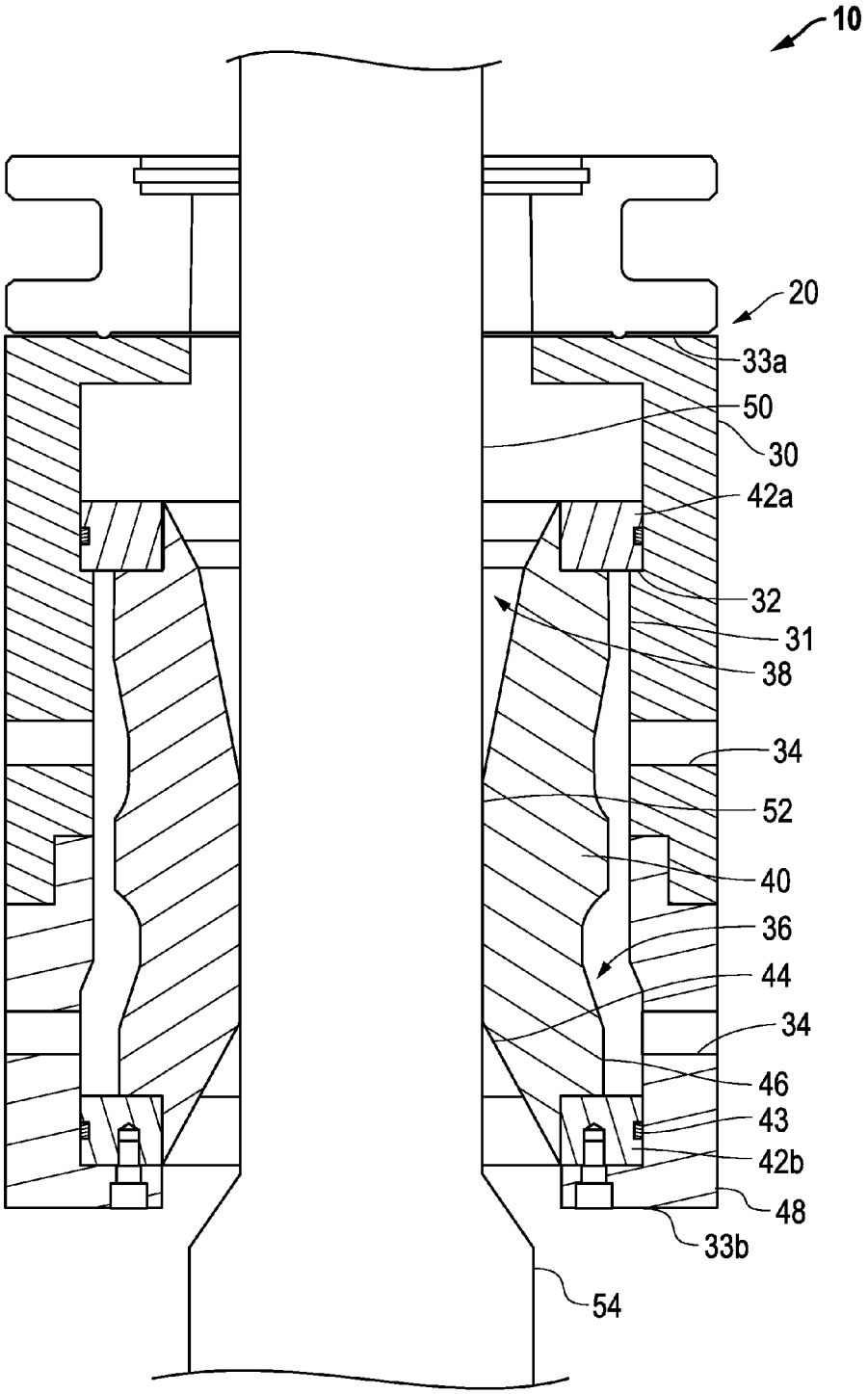
FIG. 1 depicts a cross-section view of an RCD showing an exemplary embodiment of a sealing element mounting.

FIG. 1 depicts a cross-section view of a rotational control device (RCD) or pressure control device 10 showing an exemplary embodiment of a sealing element mounting or sealing assembly 20. The RCD 10 (not fully shown but incorporated by reference) has one or more sealing elements 40 for sealing an item of oilfield equipment 50 at a wellsite (not shown but incorporated by reference) proximate a wellbore (not shown but incorporated by reference) (or in a marine environment above and/or below the water; or for directional drilling under an obstacle) formed in the earth and lined with a casing. The one or more RCDs 10 may control pressure in the wellbore. Typically, an internal portion of the RCD 10 is designed to seal around a piece of oilfield equipment 50 and rotate with the oilfield equipment 50 by use of an internal sealing element 40, and rotating bearings. The sealing elements 40 are shown and described herein as being located in an RCD 10. The one or more sealing elements 40 may be one or more annular stripper rubbers, or sealing elements 40, located within the RCD 10. The sealing elements 40 may be configured to radially engage and seal the oilfield equipment 50 during oilfield operations. Additionally, the internal portion of the RCD 10 permits the oilfield equipment 50 to move axially and slidably through the RCD 10. The oilfield equipment 50 may be any suitable, rotatable equipment to be sealed by the sealing element 40.

Sealing assembly 20 includes a support housing 30 and a sealing element 40. Support housing 30 may be located above, below or within the bearing assembly (not shown but incorporated by reference) of RCD 10. Support housing 30 is hollow within to allow for the retention and support of sealing element 40 and a piece of oilfield equipment 50. Further, support housing 30 may have a top end cap, collar or limit structure 33*a* and a bottom end cap, collar or limit structure 33*b*. The inner wall 31 of support housing 30 may also define one or more stop shoulders 32 (for example, formed by variation in the inner diameter of the inner wall 31 at the stop shoulder(s) 32). The inner wall 31 and the outer diameter 46 of sealing element 40 may also define a chamber 36. Support housing 30 also has one or a plurality of ports 34, which enable the well bore pressure to act on the outer diameter 46 of sealing element 40 through chamber 36. Stop shoulder(s) 32 may be replaced by other stop structures such as a ridge, bolt through the support housing 30, or the like.

In addition, seal assembly 20 may be a passive type seal assembly. In a passive type seal assembly 20, fluid or pressure from an external control system is not required to operate the seal assembly 20, but rather, the seal assembly 20 utilizes the wellbore pressure or static pressure to create a seal around the piece of oilfield equipment 50.

Sealing element 40 is attached or bonded to a top ring 42*a* and a bottom ring 42*b*. While the sealing element 40 may be formed from a solid flexible material, such as an elastomer or rubber, the rings 42 may be formed from rigid or stiffer materials than the flexible material used for sealing element 40, such as a metal. Top ring 42*a* and bottom ring 42*b* may have fluid-tight seals 43 adjacent to the support housing 30. Further, sealing element 40 may have an inner diameter 44, which seals against the piece of oilfield equipment 50, and an outer diameter 46. Sealing element 40, top ring 42*a*, bottom ring 42*b* and support housing 30 also define a chamber 38 through which a piece of oilfield equipment 50 may travel therethrough. In the exemplary embodiment depicted in FIG. 1, the bottom ring 42*b* of sealing element 40 is in a fixed position relative to support housing 30. The bottom ring 42*b* is fixed to support housing 30 through attaching or mounting to bottom end cap 33*b* using conventional means such as screws or bolts 48. The top ring 42*a* may float uphole and downhole a distance limited by support housing 30 as defined through the top end cap 33*a* and stop shoulder 32.

Oilfield equipment 50, as illustrated in FIG. 1, includes a drill pipe 52 and a tool joint 54. Oilfield equipment 50 may include a string of drill pipe made up of individual drill pipes 52 and tool joints 54 forming a variable diameter outer surface for the oilfield equipment 50. As shown in FIG. 1, a smaller diameter outer surface may be the outer surface of a drill pipe 52, and a larger diameter outer surface may be typically formed at a tool joint 54 between the drill pipes 52 in the string or piece of oilfield equipment 50. Both the outer surface diameter of the drill pipe 52 and the tool joint 54 may be larger than the inner diameter 44 of sealing element 40, so as to allow an interference fit between the piece of oilfield equipment 50 and the passive seal assembly 20. As a result, when tripping tool joint 54 in or out of the wellbore, the sealing element 40 may experience significant stress, friction and/or pressure which may cause damage to the sealing element 40.

The exemplary embodiment in FIG. 1 reduces or removes force or pressure end load exerted onto the passive sealing assembly 20. Wellbore pressure acts on the outer diameter 46 of sealing element 40 through ports 34 of support housing 30 to create a seal against the piece of oilfield equipment 50. But pressure end load is removed or reduced from the lower end of the sealing element 40 as the lower end does not see wellbore pressure due to the fact that the bottom ring 42*b* remains fixed to bottom end cap 33*b* (and the top ring 42*a* floats). Additionally, when stripping out the oilfield equipment 50 including tool joint 54, the sealing element 40 may move out of the way by deforming to compensate for the additional stress in two manners (in combination or separately). First, the sealing element 40 may shift uphole when pressure/friction from tool joint 54 is exerted against the sealing element 40 as the tool joint 54 is stripped out. Sealing element 40 and more specifically top ring 42*a* moves or floats to compensate for the exerted stress between stop shoulder 32*a* and top end cap 33*a*. The bottom ring 42*b* remains fixed to bottom end cap 33*b*. Second, the sealing element 40 may also deform into chamber 36 to compensate for stress and/or pressure exerted from the tool joint 54. In this manner, the pressure end load is relieved from sealing element 40 and the upper end of the sealing element 40 is free to move within the range defined by stop shoulder 32*a* and top end cap 33*a*, thus preventing the sealing element 40 from damage and/or from the event of turning inside out. Stop shoulder 32*a* also inhibits unwanted compression of the sealing element 40.

Figure 2:
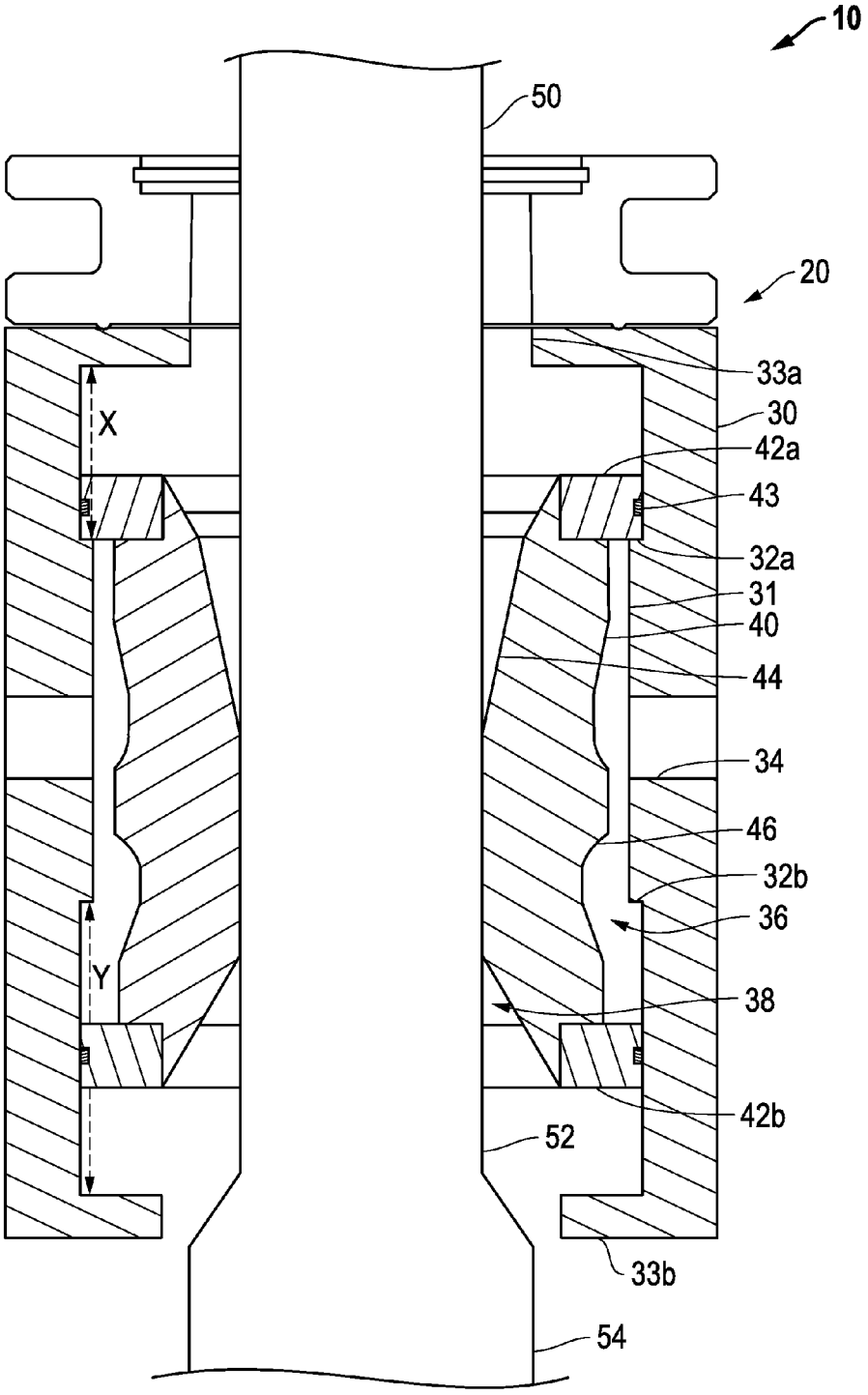
FIG. 2 depicts a cross-section view of an RCD showing an alternate exemplary embodiment of a sealing element mounting.

FIG. 2 depicts a cross-section view of an RCD 10 showing an alternate exemplary embodiment of a sealing element mounting or sealing assembly 20. For convenience, components in FIG. 2 that are similar to components in FIG. 1 will be labeled with the same number indicator. Moreover, seal assembly 20 in FIG. 2 is also a passive type seal assembly. The exemplary embodiment depicted in FIG. 2 reduces the end load created by wellbore pressure and the end load created by stripping the piece of oilfield equipment 50 in and out of the RCD 10 (by essentially keeping or maintaining the sealing element 40 in a greater state of tension as compared to or instead of allowing the sealing element 40 to bunch up in compression within a relatively limited travel space). As depicted, the sealing element 40 has been urged radially inward to seal against the piece of oilfield equipment 50. In the exemplary embodiment depicted in FIG. 2, the support housing 30 has a top end cap, collar or limit structure 33*a* and a bottom end cap, collar or limit structure 33*b* similar to FIG. 1. Support housing 30 also defines one or more ports 34 wherein the well bore pressure may act on the outer diameter 46 of the sealing element 40. However, in the exemplary embodiment depicted in FIG. 2, support housing 30 defines two stop shoulders 32 (for example, formed by variation in the inner diameter of the inner wall 31 at the shoulder(s) 32), a top stop shoulder 32*a*, and a bottom stop shoulder 32*b* through the inner wall 31 (whereas FIG. 1 depicts an exemplary embodiment with only one stop shoulder 32). Stop shoulder(s) 32 may be replaced by other stop structures such as a ridge, bolt through the support housing 30, or the like.

Further, sealing element 40 in FIG. 2 is also attached or bonded to a top ring 42*a* and a bottom ring 42*b*. Sealing element 40 also defines an inner diameter 44, an outer diameter 46. However, in the alternate exemplary embodiment depicted in FIG. 2, the bottom ring 42*b* is not fixed or attached at to the bottom end cap 33*b*, whereas, in the exemplary embodiment of FIG. 1, the bottom ring 42*b* is in a fixed position in relation to support housing 30. Thus, both the top ring 42*a* and bottom ring 42*b* of sealing element 40 have the capability to float a limited distance. Top ring 42*a* may float a distance X limited by top stop shoulder 32*a* and top end cap 33*a*. Bottom ring 42*b* may float a distance Y as limited by bottom stop shoulder 32*b* and bottom end cap 33*b*. Distance Y is greater than distance X.

FIG. 2 illustrates an exemplary embodiment which allows the sealing element 40 to float both uphole and downhole when the piece of oilfield equipment 50 is stripped into or out of the sealing element 40 based on the floating capability of the top and bottom mounting rings 42. When stripping in the tool joint 54 as Distance Y is greater than distance X, stop 32*a* is encountered prior to bottom ring 42*b* encountering bottom end cap 33*b* (hence the bottom ring 42*b* can float when stripping in and the directional forces between wellbore pressure and the tool joint 54 stripping in subtract); thusly the end load is reduced on the bottom ring when stripping in. When stripping out the tool joint 54, the stop 32*b* is encountered as the sealing element 40 floats up removing the end load. In furtherance of the foregoing, the sealing element 40 may shift or float downhole when pressure from tool joint 54 is exerted against sealing element 40 as the tool joint 54 is stripped in. As in FIG. 1, sealing element 40 may also deform into chamber 36 to compensate for stress from tool joint 54 stripping in and out of the wellbore. Thus, the exemplary embodiment depicted in FIG. 2 may reduce the wear and tear on sealing element 40 for the events of stripping a tool joint 54 in and out of a well bore, and reduce the end load created by wellbore pressure.

Figure 3:
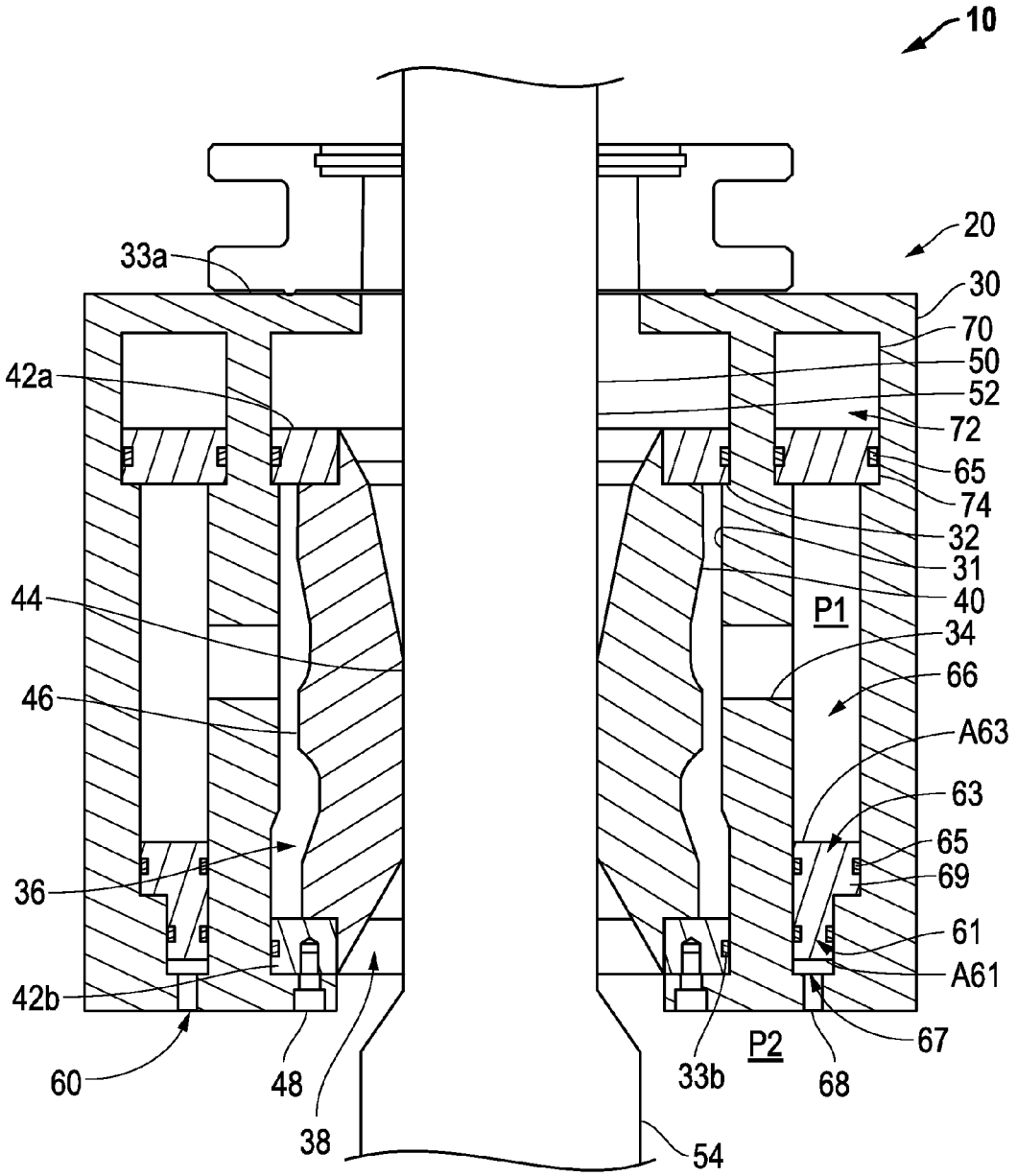
FIG. 3 depicts a cross-section view of an RCD showing an alternate exemplary embodiment of a sealing element mounting with a pressure reduction system and a nitrogen accumulator.

FIG. 3 depicts a cross-section view of an RCD or pressure control device 10 showing an alternate exemplary embodiment of a sealing element mounting or sealing assembly 20. For convenience, components in FIG. 3 that are similar to components in FIG. 1 will be labeled with the same number indicator. Moreover, seal assembly 20 in FIG. 3 is also a passive type seal assembly (i.e. activated without the need for an external control system), as are the seal assemblies 20 in FIGS. 1-2. As depicted, the sealing element 40 has been urged radially inward to seal against oilfield equipment 50. In the exemplary embodiment depicted in FIG. 3, the support housing 30 has a top end cap, collar or limit structure 33*a* and bottom end cap, collar or limit structure 33*b* similar to FIG. 1. Support housing 30 also has one or more ports 34 wherein the well bore pressure P2 may indirectly act on the outer diameter 46 of the sealing element 40.

In FIG. 3, support housing 30 further defines a pressure reduction system 60 and a nitrogen accumulator 70 adjacent to the chamber 38 which houses the sealing element 40 and the piece of oilfield equipment 50. Pressure reduction system 60 is in communication with the wellbore and supplies fluid to the RCD 10. The pressure reduction system 60 typically includes a piston assembly 69, an upper chamber 66 and a lower chamber 67. The piston assembly 69 includes a smaller piston 61 and a larger piston 63. The smaller piston 61 has a relatively smaller surface area A61 as compared to the larger piston 63 which has a relatively larger surface area A63. The pressure in upper chamber 66 and chamber 36 is labeled as P1 and the pressure in the lower chamber 67, as well as the pressure of the wellbore, is labeled as P2. The pistons 61 and 63 are constructed and arranged to maintain a pressure differential between the P1 and P2. In other words, the pistons 61 and 63 are designed with to maintain a specific surface area ratio, A61/A63, such that the pressure P1 of the chambers 36, 66 is a fraction (specifically, the fraction or ratio A61/A63) of the wellbore pressure, P2 (expressed as P1=P2*(A61/A63). This may result in a relatively significant reduction in the pressure P1 as experienced by the sealing element 40. The reduced pressure P1 also relieves stress or the friction load as experienced due to interaction between the piece of oilfield equipment 50 and the sealing element 40 at its inner diameter 44. By way of example only, the pressure differential between P1 and P2 may be 1000 psi (or 6894.7 kPa). Additionally, a plurality of seal members 65 may be disposed around the pistons 61 and 63 to form a fluid tight seal between the chambers 66 and 67.

The pressure reduction system 60 may optionally include and be in fluid communication with a compensator such as an accumulator 70 (by way of example, nitrogen filled or may be even compensated using a spring). The inclusion of a nitrogen accumulator 70 may be dependent on temperature changes, depth below sea level and/or accumulator effects requirements for passing tool joints 54. The nitrogen accumulator 70 may optionally be used as a place for fluid storage, or for compensation for pressure or temperature fluctuations in the RCD 10. The nitrogen accumulator 70 may include a nitrogen chamber 72 and a nitrogen piston 74. Additionally, one or more seal members 65 may be disposed around the nitrogen piston 74 to form a fluid tight seal between the chambers 66 and 72. If P1 in chambers 36, 66 fluctuates, as when filling the chamber 66 with oil and/or when tool joint 54 deforms or expands the sealing element 40, the nitrogen piston 74 may adjust into or out of nitrogen chamber 72 to allow for a margin of error to maintain a seal around the piece of oilfield equipment 50. Nitrogen chamber 72 may be filled with a pressure controlled volume of nitrogen gas as would be known to one having ordinary skill in the art. If the optional nitrogen accumulator 70 exemplary embodiment is utilized, by way of example only and only as a further option, but not limited to, a pressure transducer (not shown) measures the wellbore pressure P2 and subsequently injects nitrogen from a surface unit (not shown) into the chamber 72 at the same pressure as pressure P2. The pressure in the nitrogen chamber 72 may be adjusted as the wellbore pressure P2 changes, thereby maintaining the desired pressure differential, for example, of 1000 psi, between pressure P1 and wellbore pressure P2.

The pressure reduction system 60 provides reduced pressure from the wellbore to activate the sealing element 40 to seal around the piece of oilfield equipment 50. Initially, a fluid, such as oil, is filled into upper chamber 66 and is thereafter sealed. The wellbore fluid from the wellbore is in fluid communication with lower chamber 67. Therefore, as the wellbore pressure increases, pressure P2 in the lower chamber 67 increases. The pressure in the lower chamber 67 causes the pistons 61 and 63 to move axially upward forcing fluid in the upper chamber 66 to enter port 34 and pressurize the chamber 36. As the chamber 36 fills with the oil, the pressure in the chamber 36 and upper chamber 66 increases causing the sealing element 40 to move radially inward to seal around the piece of oilfield equipment 50. In this manner, the sealing element 40 is indirectly activated by the wellbore pressure, allowing the RCD 10 to seal around a piece of oilfield equipment 50. However, because the pressure reduction system 60 acts to reduce pressure P2 to a reduced pressure P1 in the chambers 36 and 66, the sealing element 40 experiences a reduced pressure load to close against oilfield equipment 50. The reduced pressure P1 also results in a lowered or reduced friction load at the inner diameter 44 of the sealing element 40. Thus, for example, while a sealing element 40 may be operated at 2500 psi wellbore pressure P2, the sealing element may only need 1500 psi closing pressure P1 to affect a sufficient seal against the piece of oilfield equipment 50, and reducing friction/stress in the sealing element 40.

In the exemplary embodiment of FIG. 3, like FIG. 1, pressure end load is removed or reduced from the lower end of the sealing element 40 as the lower end does not see wellbore pressure due to the fact that the bottom ring 42*b* remains fixed to bottom end cap 33*b* (and the top ring 42*a* floats). Additionally, when stripping out the oilfield equipment 50 and tool joint 54 in the exemplary embodiment depicted in FIG. 3, the sealing element 40 will move out of the way by deforming to compensate for the additional stress in two manners (in combination or separately). First, the sealing element 40 may shift uphole when pressure/friction from tool joint 54 is exerted against the sealing element 40 as the tool joint 54 is stripped out. Sealing element 40 moves to compensate for the exerted stress as the top ring 42*a* floats between stop shoulder 32 and top end cap 33*a* and bottom ring 42*b* remains fixed to bottom end cap 33*b*. Second, the sealing element 40 may also deform into chamber 36 to compensate for stress and/or pressure exerted from the tool joint 54. When sealing element 40 deforms into chamber 36, the nitrogen accumulator 70 may adjust to allow for a margin of error produced by the tool joint 54 contacting the inner diameter 44 of sealing element 40. In this manner, the pressure end load is relieved from sealing element 40 and the upper end of the sealing element 40 is free to move within the range defined by stop shoulder 32*a* and top end cap 33*a*, thus preventing the sealing element 40 from damage and/or from turning inside out. Stop shoulder 32*a* also inhibits unwanted compression of the sealing element 40. Furthermore, the exemplary embodiment depicted in FIG. 3 allows the passive sealing element 40 to experience only the amount of pressure necessary to seal against oilfield equipment 50, thus, further reducing the damage seen by the passive sealing element 40 (including due to friction as the tool joint 54 passes through the sealing element 40), while still maintaining wellbore pressure P2 activation. As the sealing element 40 outer diameter 46 is much larger than the inner diameter 44, a significant pressure reduction may be applied, thus reducing the pressure P1 the sealing element 40 sees in relation to the wellbore pressure. The exemplary embodiment provides the further advantage of minimizing wellbore fluid contact to only limited areas of the sealing assembly 20 such as at seal element inner diameter 44.

The exemplary embodiments of FIG. 2 and FIG. 3 may be combined (not shown) for allowing the seal member 40 to float at both ends, combined with a pressure reduction system and a nitrogen/compensation chamber.

While the exemplary embodiments are described with reference to various implementations and exploitations, it will be understood that these exemplary embodiments are illustrative and that the scope of the inventive subject matter is not limited to them. Many variations, modifications, additions and improvements are possible. For example, the implementations and techniques used herein may be applied to any strippers, seals, or packer members at the well site, such as the BOP, and the like.

Plural instances may be provided for components, operations or structures described herein as a single instance. In general, structures and functionality presented as separate components in the exemplary configurations may be implemented as a combined structure or component. Similarly, structures and functionality presented as a single component may be implemented as separate components. These and other variations, modifications, additions, and improvements may fall within the scope of the inventive subject matter.

What is claimed is:

1. A sealing assembly for sealing against a piece of oilfield equipment in a wellbore, comprising a support housing, wherein the support housing defines an inner wall and a port configured for fluid communication with the wellbore, wherein the inner wall defines a stop shoulder, and wherein the support housing has a limit structure proximate one end;

a sealing element contained within the support housing, the sealing element having an inner diameter and an outer diameter; and a ring connected to the sealing element at one end, wherein the ring is configured for slidable movement along the inner wall of the support housing and further configured to float between the stop shoulder and the limit structure.

2. The sealing assembly of claim 1, wherein the outer diameter of the sealing element, the ring and the inner wall of the support housing define a chamber in fluid communication with the port.

3. The sealing assembly of claim 2, wherein the chamber is in fluid communication with the wellbore.

4. The sealing assembly of claim 3, further comprising a wellbore pressure defined by the wellbore, wherein the port and the chamber are configured to communicate the wellbore pressure to the outer diameter of the sealing element.

5. The sealing assembly of claim 1, wherein the support housing further comprises an end cap opposite the end having the limit structure.

6. The sealing assembly of claim 5, further comprising a second ring connected to the sealing element at another end, wherein the second ring is fixed to the end cap.

7. The sealing assembly of claim 5, further comprising a second ring connected to the sealing element at another end, wherein the second ring is configured to float relative to the end cap.

8. A sealing assembly for sealing against a piece of oilfield equipment in a wellbore, comprising a support housing, wherein the support housing defines an inner wall and a port, wherein the inner wall defines a stop shoulder, and wherein the support housing has a limit structure proximate one end;

a sealing element contained within the support housing, the sealing element having an inner diameter and an outer diameter;

a ring connected to the sealing element at one end, wherein the ring is configured for slidable movement along the inner wall of the support housing and further configured to float between the stop shoulder and the limit structure; and a pressure reduction system in communication with the wellbore and the port, comprising a piston assembly having a piston, and wherein the piston assembly is configured to divide an upper chamber defined in the support housing and a lower chamber defined in the support housing;

wherein the upper chamber is in fluid communication with the port; and wherein the lower chamber is in fluid communication with the wellbore.

9. The sealing assembly of claim 8, wherein the piston further comprises a first piston having a smaller piston surface area, wherein the first piston is in communication with the lower chamber; a second piston having a larger piston surface area, wherein the second piston is in communication with the upper chamber; and wherein the first and second piston are connected to each other.

10. The sealing assembly of claim 9, wherein the upper chamber has a pressure P1 and the wellbore has a pressure P2, and further wherein P1 is lower than P2, and wherein P1 is configured for closing the sealing element against the piece of oilfield equipment.

11. The sealing assembly of claim 10, wherein the upper chamber is filled with a volume of oil.

12. The sealing assembly of claim 10, wherein the pressure P1 is configured to be exerted against the outer diameter of the sealing element.

13. The sealing assembly of claim 10 further comprising a nitrogen accumulator in fluid communication with the pressure reduction system, wherein the nitrogen accumulator comprises a nitrogen chamber defined in the support housing, configured to be filled with a volume of nitrogen gas; and a nitrogen piston, separating the upper chamber and the nitrogen chamber.

14. The sealing assembly of claim 13, wherein the nitrogen accumulator is configured to compensate and maintain a set pressure differential between the pressure P1 and the pressure P2.

15. The sealing assembly of claim 8, wherein the support housing further comprises an end cap opposite the end having the limit structure.

16. The sealing assembly of claim 11, further comprising a second ring connected to the sealing element at another end, wherein the second ring is fixed to the end cap.

17. A method for sealing against a piece of oilfield equipment in a wellbore, wherein the piece of oilfield equipment has an outer diameter of varying size, comprising the steps of stripping the piece of oilfield equipment within the wellbore;

engaging an inner diameter of a sealing element with the outer diameter of the piece of oilfield equipment, wherein the sealing element is contained in a support housing;

floating a first ring attached to the sealing element in response to the step of stripping of the piece of oilfield equipment, wherein the ring slidably moves within the support housing;

floating a second ring relative to the support housing, wherein the second ring is attached to the sealing element; and deforming the sealing element into a chamber in response to the step of stripping of the piece of oilfield equipment, wherein the chamber is defined by an outer diameter of the sealing element, the first and second rings, and an inner wall of the support housing.

18. The method according to claim 17, further comprising the step of pressurizing the outer diameter of the sealing element with a wellbore pressure.

19. The method according to claim 18, wherein the step of pressurizing the outer diameter of the sealing element with the wellbore pressure comprises the step of indirectly pressurizing the outer diameter of the sealing element with the wellbore pressure, wherein pressure within the chamber is lower than the wellbore pressure.

20. The method according to claim 17, further comprising the step of preventing the sealing element from turning inside out.

* * * * *